US006281189B1

(12) United States Patent
Heimann et al.

(10) Patent No.: US 6,281,189 B1
(45) Date of Patent: Aug. 28, 2001

(54) SOYATE CONTAINING COMPOSITIONS

(75) Inventors: Robert L. Heimann, Stoutsville; Nancy M. McGowan, Centralia; William M. Dalton, Moberly; Donald W. Taylor, Liberty, all of MO (US)

(73) Assignee: Elisha Technologies Co LLC, Moberly, MO (US)

( * ) Notice: Subject to any disclaimer, the term of this patent is extended or adjusted under 35 U.S.C. 154(b) by 0 days.

(21) Appl. No.: 09/454,331

(22) Filed: Dec. 3, 1999

Related U.S. Application Data

(60) Provisional application No. 60/110,744, filed on Dec. 3, 1998.

(51) Int. Cl.[7] ..... C11D 1/83; C11D 3/20; C11D 3/44

(52) U.S. Cl. ..... 510/491; 510/130; 510/159; 510/160; 510/421; 510/422; 510/423; 510/424; 510/434; 510/506

(58) Field of Search ..... 510/130, 159, 510/160, 421, 422, 423, 424, 434, 491, 506; 424/405

(56) References Cited

U.S. PATENT DOCUMENTS

| | | | | |
|---|---|---|---|---|
| 5,340,495 | * | 8/1994 | Mulcahy et al. | 252/162 |
| 5,382,298 | * | 1/1995 | Bondurant | 134/42 |
| 6,004,916 | * | 1/2000 | Mills et al. | 510/238 |
| 6,010,710 | * | 1/2000 | Etchegaray | 424/405 |
| 6,017,862 | * | 1/2000 | Doyel et al. | 510/163 |

* cited by examiner

*Primary Examiner*—Gregory DelCotto
(74) *Attorney, Agent, or Firm*—Michael K. Boyer

(57) ABSTRACT

A composition is disclosed that comprises at least one soybean oil derived compound and at least one member chosen from the group of drying agent(s), co-solvents and additives. The composition can comprise methyl soyate and d-Limonene.

14 Claims, No Drawings

SOYATE CONTAINING COMPOSITIONS

The subject matter herein claims benefit under 35 U.S.C. 111(a) and 35 U.S.C. 119(e) of U.S. Provisional Patent Application Ser. No. 60/110,744, filed on Dec. 3, 1998 and entitled "Improved Soyate Containing Compositions"; the disclosure of which is hereby incorporated by reference.

FIELD OF THE INVENTION

The instant invention relates to improved compositions and cleaners containing soybean oil derived compounds.

BACKGROUND OF THE INVENTION

Soybean oil derived compounds such as methyl soyate have been considered for use as a solvent cleaner. Methyl soyate is desired since it is non-toxic and environmentally acceptable. Methyl soyate, however, has a relatively high flash point, e.g., 650 F. (and a boiling point of 216 C.), and has a tendency to leave a residual oily film. There is a need in this art for a methyl soyate containing cleaner/solvent that has improved rinsing, drying and cleaning characteristics, and antibacterial or antimicrobial characteristics.

SUMMARY OF THE INVENTION

The instant invention solves problems associated with conventional practice by combining at least one soybean oil derived compound with at least one member selected from the group consisting of drying agent(s), co-solvents, additives, mixtures thereof, among others.

The inventive composition can replace toxic chlorinated solvents, glycol ether, MEK (methyl ethyl ketone), xylene, chlorofluorocarbons, among other conventional and environmentally undesirable cleaners/solvents. The inventive composition can be employed as a general purpose cleaner, parts cleaner, engine degreaser (automotive, aircraft, and aerospace industries), electronics cleaning, Cosmoline® remover, tar and asphalt removal, graffiti remover, sewage treatment applications, hand cleaner, floor cleaner, printing press cleaner, carpet stain removal, metal cleaner, vinyl cleaner (e.g., commercial and residential vinyl siding), additive to an aerosol compound, heat transfer medium, among other uses. The inventive composition can also be employed as an insect repellant, e.g., as a fly repellant for cattle, sheep, goats, and horses; and deployed as a carrier for other insecticides.

DETAILED DESCRIPTION

The instant invention relates to a cleaner/solvent composition and method or making the composition. The composition comprises at least one soybean oil derived compound, e.g., methyl soyate, and at least one drying agent, e.g., about 0.5 wt. % to at least about 20 wt. % of at least one drying agent. The composition can also include at least one co-solvent for the soybean oil derived compound and/or the drying agent, e.g., about 1 to about 30 wt % of one or more co-solvents. The composition can also include at least one additive to enhance emulsification, wetting, stability, color, viscosity, among other chemical or physical properties, e.g., greater than about 0 to about 25 wt. % of additives.

The soybean oil derived compound can comprise at least one member selected from the group consisting of methyl soyate, lecithin, soy oil alkanolamides, hydrogenated soy oil derivatives, among other compounds based upon chemically or physically modified soybean oil. Depending upon the end-use of the composition, the amount of soybean oil derived compound normally ranges from about 5 to 75 wt. % of the composition.

The drying agent can comprise an effective amount at least one member selected from the group of d-Limonene, and if permitted by local regulations hydrocarbons such as dimethoxymethane, acetone, methanol, ethanol, isopropyl alcohol mixtures thereof, among others. By "effective amount" it is meant that the drying agent functions as an antioxidant, antimicrobial agent, odorant, or penetrating agent for the soybean oil derived compound. When the drying agent comprises d-Limonene, depending upon the grade the d-Limonene normally comprises about 70 to at least 95 wt. % d-Limonene and the remainder at least one member selected from the group selected from terpene hydrocarbons and oxygenated compounds such as octanol, nonanal, decanal, linalool, mixtures thereof, among others.

The co-solvent can comprise at least one member selected from the group consisting of water, soybean oil, hydrocarbon glycols, mixtures thereof, among others. The co-solvent can also comprise at least one propellant that is used for pressurized dispensing of the composition.

The additives are employed for tailoring the composition to achieve a defined characteristic. Examples of additives comprise at least one member selected from the group of corrosion inhibitor(s) such as ammonium silicate, alkali metal silicates, e.g., calcium/sodium silicate, potassium silicate, among other commercially available corrosion inhibitors; surfactants; colorants; emulsifiers, viscosity control agents; antimicrobial compounds; pH modifiers, among other compounds conventionally used in cleaners/solvents. In some cases, the additive may perform more than function, for example, depending upon the amount water can function as an emulsifier as well as a co-solvent.

In one aspect of the invention, the additive comprises an effective amount of at least one pH modifier. The pH can be increased or rendered basic by adding an effective amount of at least one silicate, hydroxide, among other compounds. The pH can be decreased or rendered acidic by adding an effective amount of at least one acid, benzoic acid, acetic acid, formic acid, citric acid, phosphoric acid, oleic acid, among other compounds. In one specific aspect, aqueous phosphoric acid, e.g., about 1–20% phosphoric acid, is employed as an additive to obtain a cleaner.

In another aspect of the invention, the inventive composition is combined with an additive comprising at least one commercially available shampoo and employed for washing pets, domesticated animals such as horses. The inventive composition enhances the cleaning and insect repellant properties of the shampoo.

In another aspect of the invention, the inventive composition is combined with an additive that comprises at least one emulsifier. The inventive composition is combined with an amount of an emulsifier effective to form an emulsion. The emulsion need not be stable for long periods of time so long as the emulsion can be re-created by shaking. While any suitable emulsifier can be employed, a desirable emulsion can be obtained by using water, e.g., about 25 to about 75 wt. % water or deionized water.

In a further aspect of the invention, the inventive composition is combined with an additive comprising at least one sulfated and sulfonated anionic surfactants, polyethylene glycol; sodium, barium and calcium petroleum sulfates, ester containing compounds (e.g., Emerest 2302 supplied by Witco), N-methyl pyrolidone, diapropylene glycol n-butyl ether, stearates including calcium stearates, phenol ethoxylates, nonylphenyl ethylen oxide condensates, alkanolamides including detergents, alcohols and ethoxylates, triethanolamine, ethoxylated glycerides, butyl cellulose, among others.

While the inventive composition can include any compounds that are miscible with the inventive composition or will become dispersed by agitation, the composition is normally substantially free of the undesirable cleaners/ solvents listed in the Summary of the Invention. By "substantially free", it is meant that the inventive composition contains less than about 10 wt. % of such compounds.

The inventive composition can be prepared by combining the ingredients in any suitable manner. An example of a suitable method comprises combining the ingredients in a commercially available mixer such as those supplied by Premier Mill.

While the inventive composition can be applied by any of the aforementioned methods, particularly desirable results have been obtained by spraying the composition from a hand actuated spray bottle. The inventive composition can also be dispensed in a stream or in an aerosol. For example, the inventive composition can be packaged in a an aerosol container and dispensed by a propellant such as at least one member selected from the group consisting of hydrocarbons including alcohol, butane, propane; fluorocarbons such as difluoroethane (HFC-152), tetrafluoroethane (HFC-134a); carbon dioxide; mixtures thereof, among other commercially available propellants.

The inventive composition can be employed for cleaning or removing a wide range of materials. The inventive composition can be employed to clean/remove polyalphaolefins, polybutenes, epoxies, swaging oil, honey oil, buffing compounds, cutting fluids, among other materials. For example, the inventive composition can be employed to clean-up or remove residual materials such as the corrosion resistant materials disclosed in U.S. patent application Ser. Nos. 09/016,849, filed on Jan. 30, 1998 in the names of John Hahn et al. and entitled "Corrosion Protective Coatings" and Ser. No. 09/370,346, filed on Aug. 9, 1999 in the names of Robert L. Heimann et al. in the names of Robert L. Heimann et al. and entitled "Corrosion Resistant Lubricants, Greases and Gels"; the disclosure of which is hereby incorporated by reference.

The inventive composition can be removed readily by wiping or spraying with water or an aqueous solution. The removal rate can be enhanced by agitation and/or exposure to relatively hot water, e.g., 140 to 160 F.

While the above description places particular emphasis on a cleaning/solvent composition, the inventive composition can also be an intermediate product that is combined with other substances. In one aspect, the inventive composition can be added to compounds that are used for treating wood, concrete, among other surfaces. That is, the inventive compound can be added to a staining compound for coloring wood and concrete. In another aspect, the inventive composition is combined with a release oil such as silicon and employed as a mold release agent. In a further aspect, the inventive composition is employed as an intermediate product or carrier for at least one other composition, e.g., the inventive composition is used as a carrier for an insecticide.

While the above description emphasized a soybean oil derived compound, the instant drying agent can be employed with other vegetable oil derived compounds (e.g., canola, corn, sunflower, linseed, meadowfoam, mixtures thereof, among others). Such vegetable oil derived compounds can also be included as an additive to the instant composition.

The following Examples are provided to illustrate certain aspects of the invention and shall not limit the scope of the appended claims.

EXAMPLE 1

A 255 ML batch of the inventive composition was prepared. The inventive composition comprised: 85 ML Emulsifiable Methyl Soyate (Teksol E-SME/Lockhart Chemical Co.), 85 ML Soybean Oil/Soy Co. LLC (Adams, Wis.) and 85 ML Deionized Water. The components were combined and mixed within a 2-inch diameter type "D" disperser blade (INDCO) at 2000 RPM for 15 minutes.

Air that was entrained during the mixing was removed by placing the batch in vacuum at 25 in. Hg/1 hr. The resultant product was a yellowish milky emulsion.

The product was poured into a commercially available trigger-type hand sprayer. The product was dispensable from the sprayer.

The product can be used for imparting corrosion resistance, an anti-seize compound, rust/oil solvent or penetrating liquid, among other uses.

EXAMPLE 2

A composition comprising 40% wt. emulsifiable methy/soyate (Teksol E-SME/Lockhart Chemical Co.), 40% wt. d-Limonene, Technical (Florida Chemical Co.) and 20% wt. de-ionized water is prepared in accordance with the method described in Example 1. This composition can be employed as a cleaner for a wide range surfaces including metals, ceramics and plastics

What is claimed is:

1. A cleaning composition comprising a combination comprising methyl soyate, d-limonene, an amount of at least one pH modifying agent effective to cause said composition to have an acidic pH, and at least one co-solvent comprising water and wherein said composition is substantially free of methy ethyl ketone.

2. A degreasing composition comprising a combination comprising methyl soyate, d-limonene and an amount of at least one pH modifying agent effective to cause said composition to have an acidic pH wherein said composition is substantially free of methyl ethyl ketone.

3. The degreasing composition of claim 2 further comprising water in an amount effective to emulsify the composition.

4. The composing of claim 1 said at least one pH modifier comprises at least one member selected from the group consisting of benzoic acid, acetic acid, formic acid, citric acid, phosphoric acid and oleic acid.

5. The composition of claim 1 wherein the d-limonene comprises about 0.5 to about 20 wt. % of the composition.

6. The composition of claim 1 further comprising at least one additive selected from the group consisting of at least one sulfated and sulfonated anionic surfactants, polyethylene glycol; sodium, barium and calcium petroleum sulfates, ester containing compounds, N-methyl, pyrrolidone, stearates including calcium stearates, phenol ethoxylates, nonylphenyl ethylene oxide condensates, alkanolamides including detergents, alcohols, ethoxylates, triethanolamine, ethoxylated glycerides, and butyl cellulose.

7. The composition of claim 1 wherein said co-solvent comprises about 1 to about 30 wt. % of the composition.

8. The composition of claim 4 wherein said pH modifier comprises phosphoric acid.

9. The composition of claim 8 wherein said phosphoric acid comprises about 1 to about 20 wt. % of said composition.

10. A cleaning composition comprising a combination comprising methyl soyate, d-limonene, an effective amount of at least one pH modifying agent effective to cause said composition to have an acidic pH, and at least one emulsifier in an amount effective to form an emulsion wherein said composition is substantially free of methyl ethyl ketone.

11. The composition of claim 10 wherein said at least one emulsifier comprises water.

12. The composition of claim 11 further comprising at least one propellant selected from the group consisting of hydrocarbons and fluorocarbons.

13. The composition of claim 10 wherein the methyl soyate comprises about 5 to about 75 wt. % of the composition.

14. The composition of claims 10 wherein the d-limonene comprises about 0.5 to about 20 wt. % of the composition.

* * * * *